US006312286B1

(12) United States Patent
Fetter et al.

(10) Patent No.: US 6,312,286 B1
(45) **Date of Patent: *Nov. 6, 2001**

(54) SELF-POSITIONING METAL HOLD-DOWN

(75) Inventors: Joel D. Fetter; Deborah A. Ingram, both of Etters, PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/455,860

(22) Filed: Dec. 7, 1999

(51) Int. Cl.[7] ..... H01R 13/73
(52) U.S. Cl. ..... 439/571
(58) Field of Search ..... 439/571, 572, 439/573, 567, 569, 570, 95, 247, 248, 716; 248/581, 599, 612, 680, 346.03, 346.5

(56) References Cited

U.S. PATENT DOCUMENTS

| | | | |
|---|---|---|---|
| Re. 34,430 | 11/1993 | Mosquera et al. | 439/248 |
| 3,673,545 | 6/1972 | Rundle | 339/64 M |
| 3,803,533 | 4/1974 | Taplin | 339/91 |
| 5,171,165 | 12/1992 | Hwang | 439/567 |
| 5,175,410 | 12/1992 | Freedman et al. | 219/121.63 |
| 5,601,453 | 2/1997 | Horch | 439/567 |
| 5,632,649 | 5/1997 | Spangler | 439/567 |
| 5,791,925 | 8/1998 | Yu | 439/326 |
| 5,857,871 | 1/1999 | Horchler | 439/567 |
| 6,036,517 * | 3/2000 | Byrne | 439/215 |
| 6,042,420 * | 3/2000 | Long | 439/570 |
| 6,053,768 * | 4/2000 | Chiang | 439/571 |
| 6,074,232 * | 6/2000 | Choy et al. | 439/238 |

* cited by examiner

*Primary Examiner*—Gary Paumen
*Assistant Examiner*—Ross Gushi
(74) *Attorney, Agent, or Firm*—Woodcock Washburn Kurtz Mackiewicz & Norris LLP

(57) ABSTRACT

A hold-down is provided for securing an electrical connector to a printed circuit board. The hold-down is mounted to the housing and/or arms of the electrical connector. The hold-down comprises a base; a first portion formed at one end of the base, with a first terminal extending from the other end of the first portion and substantially parallel to the base; and a second portion formed at the other end of the base, with a second terminal extending from the other end of the second portion and substantially parallel to the base. The hold-down pivots or is free-floating, and therefore, provides coplanarity among the terminals in the electrical connector and the hold-down.

20 Claims, 6 Drawing Sheets

SELF-POSITIONING METAL HOLD-DOWN

FIELD OF THE INVENTION

This invention generally relates to a hold-down for electrical connectors, and particularly to an improved device for securing an electrical connector to a circuit board.

BACKGROUND OF THE INVENTION

Hold-downs are generally used to retain electrical connectors on a mounting substrate such as PCBs. Many types of hold-downs can be used to secure the components together. For example, if the use of solder is undesired, the hold-down used may be a rivet or nut and bolt combination. These forms of hold-downs are necessary when the interconnection needs to minimize lateral (X and Y plane) movement relative to the interconnection. Hold-downs may also need to resist unwanted vertical (Z plane) movement such as from mating and unmating forces. Rivets and nut and bolt combinations may be adequate but are expensive and time consuming to manufacture or assemble.

Another typical conventional method of mounting an electrical connector to a printed circuit board is by means of a post provided integrally with the lower surface of the insulating housing of the electrical connector. For example, when the insulating housing is comprised of a plastic material, the conventional hold-down device consists of a post, integrally formed from the plastic housing. The hold-down function is achieved by an interference fit between the post and a corresponding insert opening on the printed circuit board. The connector must be pressed downward so that the plastic post fits into a corresponding opening in the printed circuit board in order to secure the connector on the printed circuit board. Although the conventional interference fit hold-down device can mount an electrical connector tightly on the printed circuit board, such an interference fit plastic post may present problems such as those discussed below.

Among the drawbacks of an interference fit device is the limited dimensional tolerance allowed between the post and the corresponding aperture on the printed circuit board. The problem of maintaining the precisely allowable tolerance between the post and opening is such that even modest variation in the dimension of post or insert opening may cause insufficient retention capability and may result in an unreliable electrical connection between the connector and printed circuit board. Even a slight dimensional variation also may result in excessive interference between the post and opening. This makes it difficult if not impossible to insert the post into the printed circuit board without danger of breaking off or fracturing the post and thereby rendering the entire connector useless.

In order to avoid the foregoing problem, it is necessary to impose significant manufacturing constraints to prevent dimensional variations from occurring during the manufacturing process. This in turn has the disadvantage of significantly increasing the difficulty and cost of manufacturing.

Another disadvantage of a typical interference fit hold-down device arises from the dissimilar thermal expansion coefficients between the integrally molded plastic mounting post and the printed circuit board. When the thermal expansion coefficients of the plastic mounting post and the printed circuit board are sufficiently different, the insert opening on the printed circuit board may apply a force to the free end of the post and cause fracturing or failure of the mounting post.

Another problem of a conventional hold-down device molded from plastic material is that plastic is easily scratched or otherwise subject to abrasion. Also, the conventional hold-down post tends to crack easily during an inappropriate insert-extract operation due to the lack of flexibility of the plastic or the insulating material.

Moreover, conventional hold-downs are typically driven into the connector housing. This fixed positioning can lead to non-coplanarity between the hold-down and the contacts in the electrical connector such as when thermal cycling of the connector occurs, for example during the reflow process which secures the connector to the printed circuit board.

What is needed therefore is a mounting means or hold-down device for securing an electrical connector to a printed circuit board which is not subject to breaking, fracturing or other structural failure, and can float freely in the connector to provide coplanarity between the hold-down and the connector contacts to compensate for any twisting in the housing caused, for example, by thermal cycling.

SUMMARY OF THE INVENTION

The present invention is directed to a hold-down for securing an electrical connector to a printed circuit board wherein the electrical connector is characterized by an insulator housing having a plurality of apertures, each for receiving at least one of a corresponding plurality of contacts, and the insulator housing further comprising at least one aperture for receiving the hold-down. The hold-down comprises a base; a first portion formed at one end of the base at a first predetermined angle, a first terminal extending from the other end of the first portion and substantially parallel to the base; and a second portion formed at the other end of the base at a second predetermined angle, a second terminal extending from the other end of the second portion and substantially parallel to the base.

According to one aspect of the invention, the first hold-down has a pivot or a barb formed towards an end thereof.

According to another aspect of the invention, the second hold-down has a retaining feature formed towards an end thereof.

According to another aspect of the invention, the third hold-down has a bump or a tab formed on a surface thereof.

The foregoing and other aspects of the present invention will become apparent from the following detailed description of the invention when considered in conjunction with the accompanying drawings.

DESCRIPTION OF EXEMPLARY EMBODIMENTS AND BEST MODE

Figure 1:
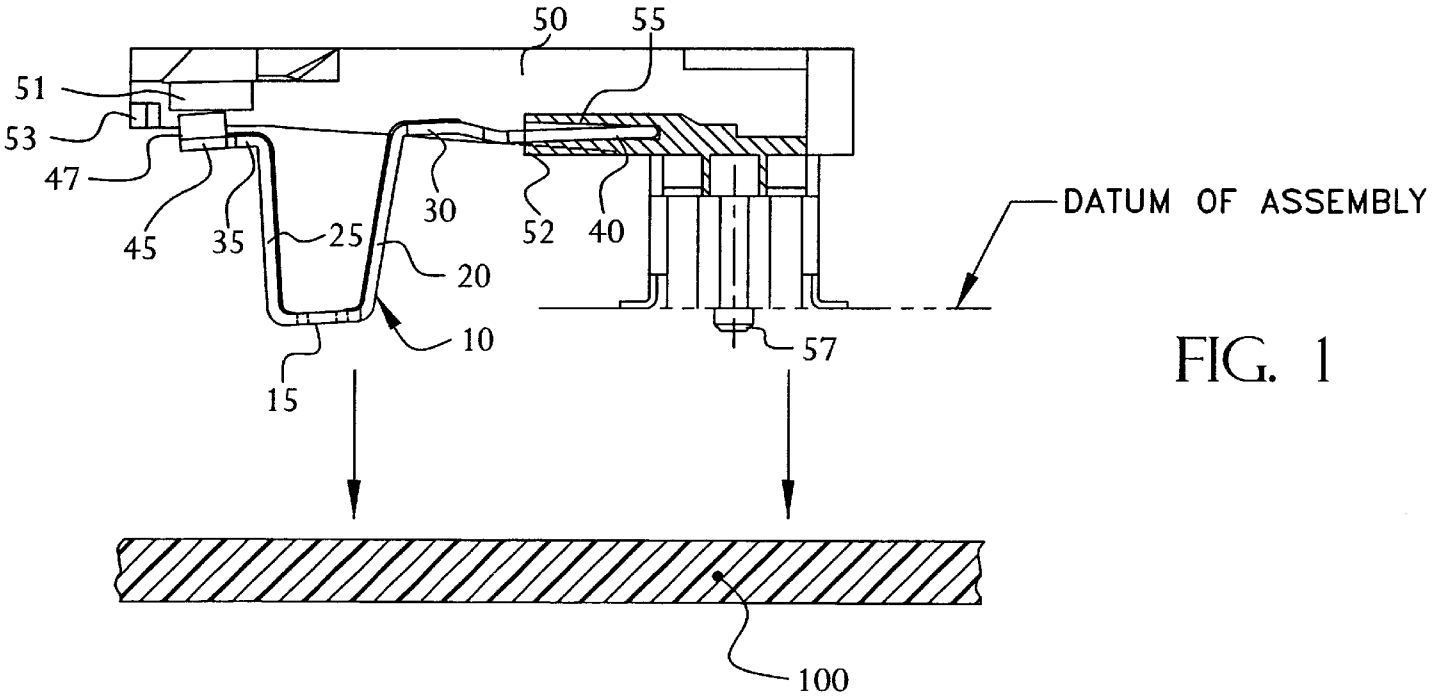
FIG. 1 shows a side view of an exemplary hold-down assembly in accordance with the present invention, prior to mounting to a substrate.
Figure 2:
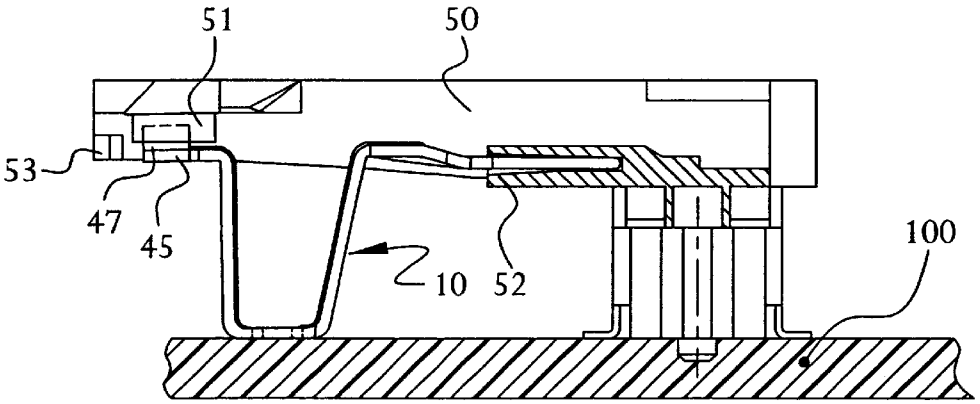
FIG. 2 shows a side view of the hold-down assembly of FIG. 1 after being mounted to a substrate.

FIG. 1 shows a side view of an exemplary hold-down assembly in accordance with the present invention, prior to mounting to a substrate 100 such as a printed circuit board, and FIG. 2 shows a side view of the hold-down assembly of FIG. 1 after being mounted to the substrate 100. The hold-down 10 is preferably stamped and formed from a suitable material, such as metal, and comprises a base portion 15 that connects to a first portion 20 and a second portion 25. The base 15 will connect to a substrate 100 such as a printed circuit board. The first portion 20 is formed at an end of the base 15 and extends transversely from the base 15 at an angle preferably greater than about 90 degrees from the base 15. A first terminal 30 extends from the other end of the first portion 20, substantially parallel to the base 15. At the other end of the first terminal 30 is a pin 40 that will extend into a housing 50 in an electrical connector. The second portion 25 is formed at the other end of the base 15 and extends transversely therefrom at an angle preferably about 90 degrees from the base. A second terminal 35 extends from the other end of the second portion 25, substantially parallel to the base 15. The hold-down 10 is preferably formed from a single piece of a resilient material, such as stamped metal. Alternatively, the hold-down 10 could be formed from any resilient material, including plastic.

The housing 50 is part of a connector (e.g., shown in FIG. 6) that will ultimately connect to a substrate 100, such as a printed circuit board. An insertion tool (not shown) can be used to push the hold-down 10 into the housing 50. The pin 40 of the terminal 30 extends into a hole, opening, or slot 55 in one end of the housing 50. The housing 50 has lead-ins or guides 52 for guiding the terminal 40 of the hold-down 10 into the appropriate hole or slot 55.

The hole or slot 55 acts as a retention feature to retain the hold-down 10 within the housing 50. The hold-down 10 pivots in the housing hole or slot 55. The length of the end 40 of the hold-down 10 that is inserted in the hole or slot 55 controls the amount that the hold-down 10 can rotate or travel in the vertical plane. The length controls the hold-down tighter than the pivot. The amount of rotation of the hold-down 10 is controlled by the size of the hole 55 in relation to the size of the pivot. Because the hold-down can pivot, it is considered free floating, and thus provides coplanarity among the terminals in the connector and the hold-down.

The hold-down 10 has a retaining feature 47 on the end 45 thereof for allowing the hold-down 10 to deflect back as the assembly makes contact with the substrate 100. The retaining feature 47 interacts with a tab 51 in the housing 50. An area between the surface of the housing 50 and the tab 51 limits the amount that retaining feature 47, and thus the hold-down 10, can move sideways. After the hold-down 10 is positioned in the assembly, the retaining feature 47 is positioned behind the tab 51. A ramp 53 on the housing 50 allows insertion of the hold-down 10 into slot 55, but also serves as a positive stop to prevent the hold-down 10 from falling out of the slot 55.

In this embodiment, the hold-down 10 is not securely detained within a housing structure by use of retention features. There is no interference taking place between the walls of the housing structure and the hold-down 10 itself. The hold-down 10 does not pivot, and instead just rocks, with the retaining feature 47 preventing the hold-down 10 from coming out of the housing 50 when the hold-down 10 is moved in a certain direction (e.g., sideways and opposite the insertion direction). Also shown is an optional pin or plug 57 that can be part of the housing 50 to provide additional stability and support. Because of the ability of the hold-down 10 to move in a rocking manner, the hold-down 10 will be coplanar with a given datum, such as a mother-board. Thus, the rocking movement allows movement in the vertical plane thus allowing a self-positioning hold-down in relationship to a motherboard. If more than one hold-down is used, as shown in FIG. 6 for example, the hold-downs position themselves and become coplanar to one another.

Figure 3:
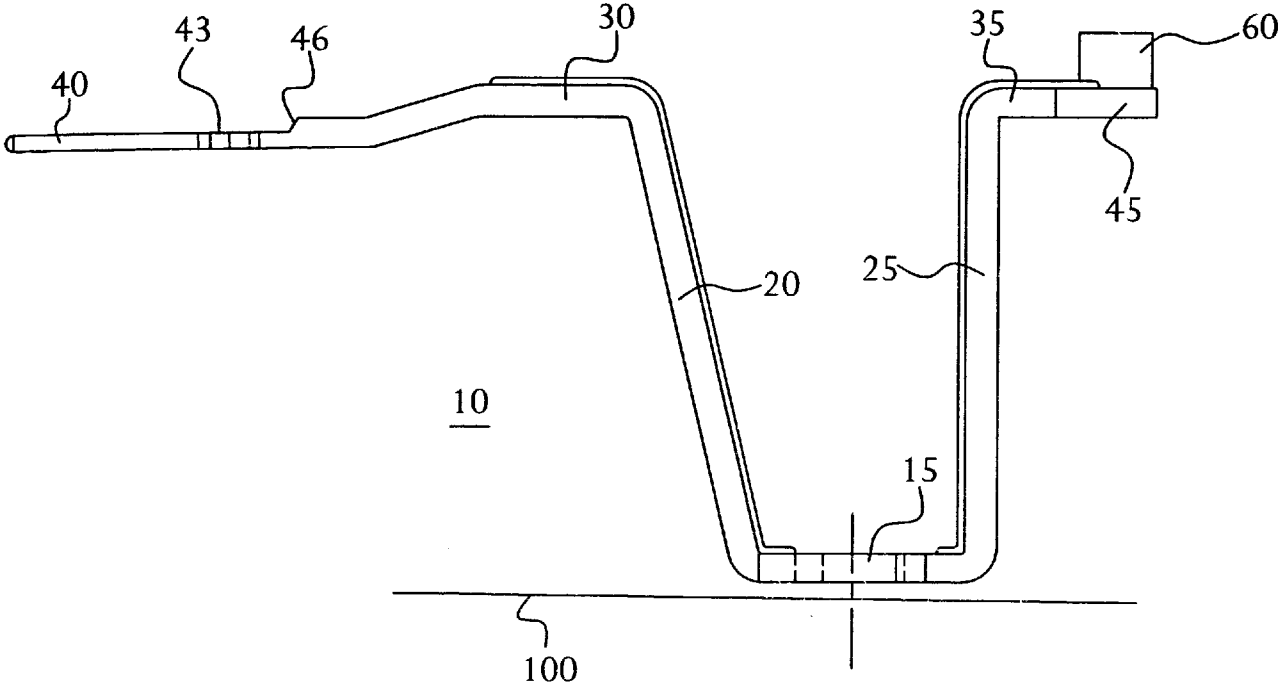
FIG. 3 shows a side view of another exemplary hold-down in accordance with the present invention.
Figure 4:
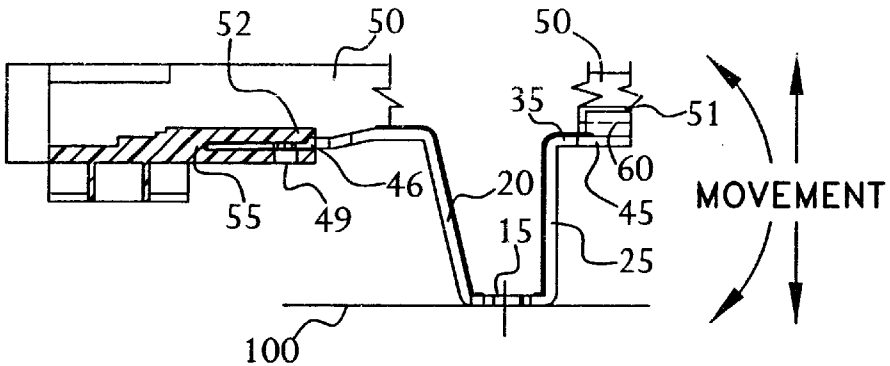
FIG. 4 shows a side view of the hold-down of FIG. 3 incorporated into a connector housing in accordance with the present invention.
Figure 5:
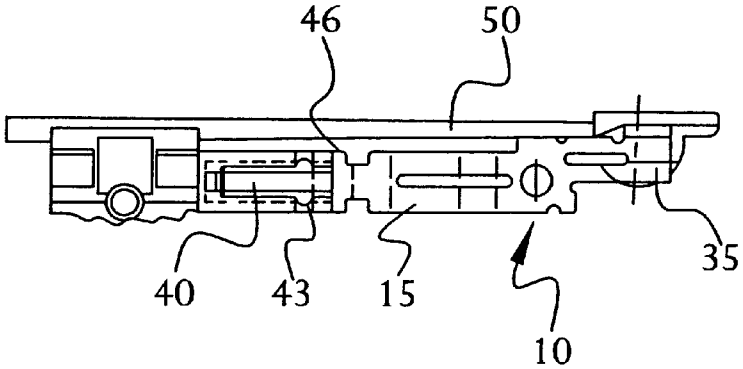
FIG. 5 shows a top view of the hold-down assembly of FIG. 4.

FIG. 3 shows a side view of another exemplary hold-down 10 in accordance with the present invention. The hold-down 10 is similar to the hold-down described above. FIG. 4 shows a side view of the hold-down 10 of FIG. 3 inserted into a connector housing 50 in accordance with the present invention. FIG. 5 shows a top view of the hold-down 10 incorporated within the housing 50 of FIG. 4. As described above, the housing 50 is part of a connector (shown in FIG. 6) that will ultimately connect to a substrate 100, such as a printed circuit board. A projection 43 extends from a proximal end of the terminal. Preferably, opposed minor sides of the terminal 40 have projections 43. The projections interference fit within grooves 55, or are inserted until the projections reach an opening 49 that prevents the projection from exiting groove 55. Because the hold-down can pivot, it is considered free floating, and thus provides coplanarity among the terminals in the connector and the hold-down. Similar to the retaining feature 47 of the hold-down described above, a tab 60 is disposed at the end 45 of the terminal 35. The tab 60 interacts with a block or tab 51 within the housing 50 to limit the amount that the hold-down 10 can move sideways in the housing 50.

The hold-down further comprises an insertion limiting feature 46 disposed along the terminal 30. The feature 46 is preferably a step or a projection that prevents the terminal 40 from being inserted any further into the hole or slot 55 in the housing. It should be noted that in this embodiment, the hole or slot 55 in the housing is not slanted or ramped, as in the embodiment described with respect to FIGS. 1 and 2. In the present embodiment, the interior walls of hole or slot 55 are parallel, and thus the feature 46 prevents the terminal 40 from being inserted beyond a predetermined point in the hole or slot 55.

Figure 6:
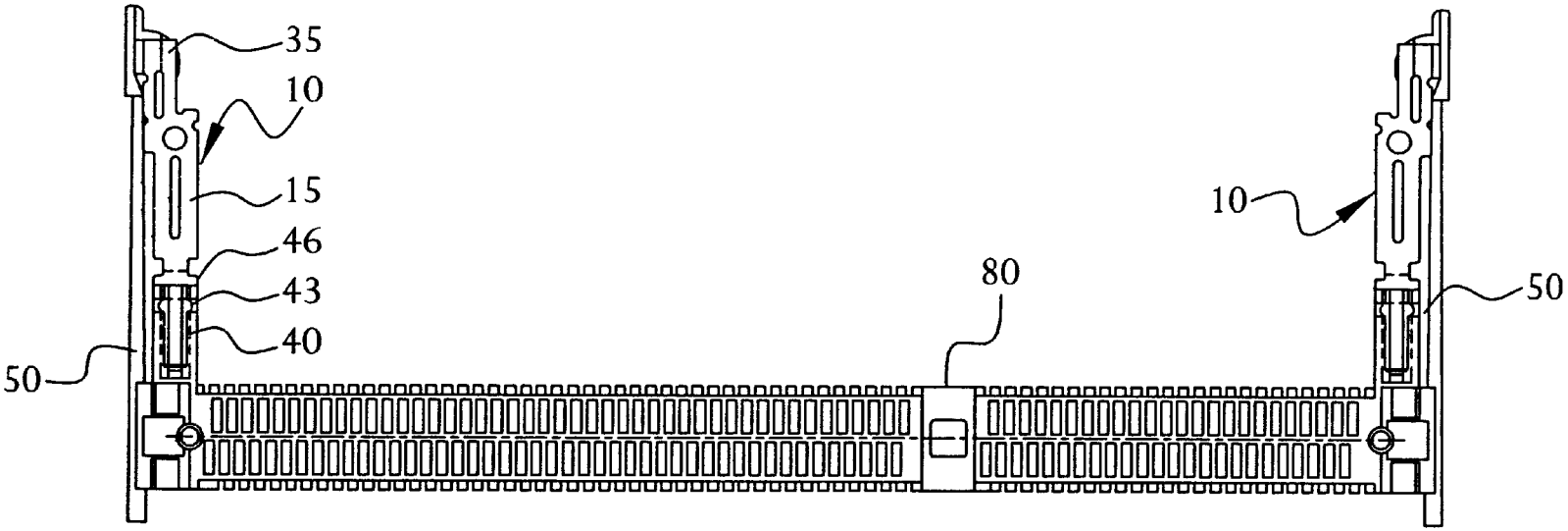
FIG. 6 shows a top view of an exemplary connector incorporating the hold-down assembly of FIG. 4.

A housing 50 is preferably formed at each end of a connector 80 as an arm, preferably orthogonal to the connector, as shown in FIG. 6, and a hold-down 10 is associated with each housing 50 or arm. The electrical connector 80 that embodies the hold-downs 10 of the present invention has improved coplanarity, thereby leading to improved connective stability. This allows for twisting and bowing that will not affect the location of the hold-down to the connected substrate or circuit board. The hold-downs also provide support and prevent overstress. The electrical connector 80 is characterized by an insulator housing having a plurality of apertures, each for receiving at least one of a corresponding plurality of contacts. The contacts are inserted into the housing prior to mounting to the substrate or circuit board, as is the hold-down. In accordance with the present invention, the hold-down will be co-planar with the contacts when the connector, including the hold-down(s), is mounted to a substrate such as a printed circuit board. The present invention can be used with any electrical connector.

Figure 7:
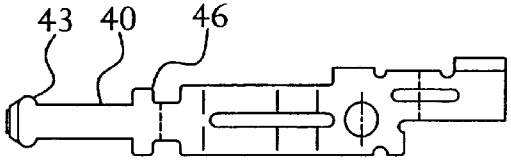
FIG. 7 shows a top view of another exemplary hold-down in accordance with the present invention.

FIG. 7 shows a top view of another exemplary hold-down in accordance with the present invention. The hold-down 10 is similar to the second embodiment described above with the exception that the pivot or barb 43 is located closer to the distal end of the terminal 40. The pivot 43 can dig into the housing 50, rather than residing in an opening in the wall of slot 55 described with respect to FIGS. 3 and 4. In this embodiment, however, the pivot 43 is disposed at the end of the terminal 40 that gets initially inserted into the slot 55 of the housing 50. Thus, the hold-down 10 is held in the housing 50 by interference between the housing 50 and the pivot 43.

The hold-down 10 also preferably includes a stop 46 that limits insertion of the terminal 40 into the slot 55 of the housing 50. The stop 46 does not get inserted into the slot 55, as does the pivot 43.

Figure 8:
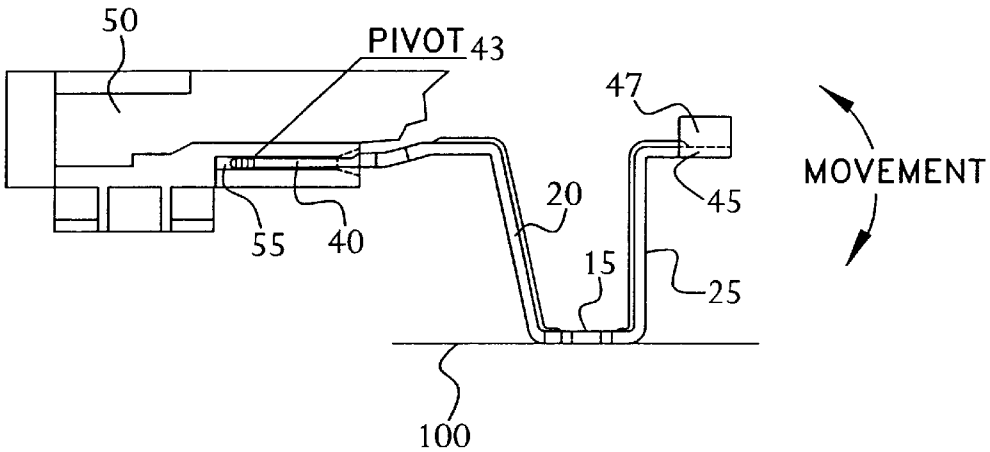
FIG. 8 shows a side view of the hold-down of FIG. 7 incorporated into a connector housing in accordance with the present invention.
Figure 9:
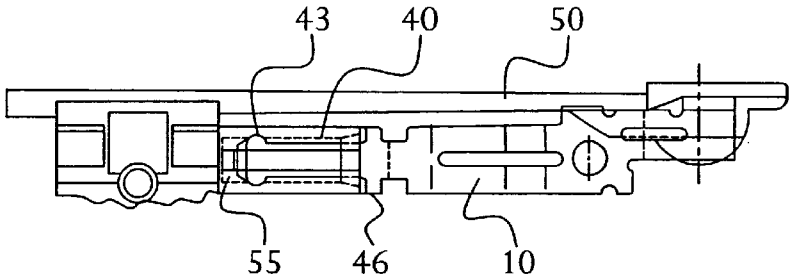
FIG. 9 shows a top view of the hold-down assembly of FIG. 8.

FIG. 8 shows a side view of the hold-down of FIG. 7 incorporated into a connector housing 50 in accordance with the present invention, and FIG. 9 shows a top view of the hold-down assembly. The terminal 40 is inserted into the housing slot 55, and the pivot 43 digs into the sidewalls of the slot 55, thus securing the hold-down 10 to the housing 50. The stop 48 prevents the terminal 40 from going any further into the slot 55. Also shown is an optional retaining feature 47 on the end 45, similar to that described above with respect to FIG. 5 to limit sideways movement of hold-down 10.

In the present embodiment, the hold-downs are self-positioning. They however have interference between the housing structure (slot 55) and retention features (pivots 43) located on the hold-down itself The barbs/pivots 43 are located such that they provide lateral force to the sidewalls of the slot 55, thereby allowing the hold-down to pivot in the vertical plane. The movement of the hold-down is controlled by the width of the slot 55 in relationship to the length of the hold-down feature (terminal 40) that inserts into the slot 55. Thus, the hold-down pivots around, or rocks on, a pivot point, and is not truly free floating. During mounting of the connector to a circuit board, the hold-down rotates within the slot 55 until it hits the circuit board that it is being mounted to. If two separate hold-downs are used in a connector (as shown, for example in FIG. 6), they will become coplanar to the circuit board during mounting.

Figure 10:
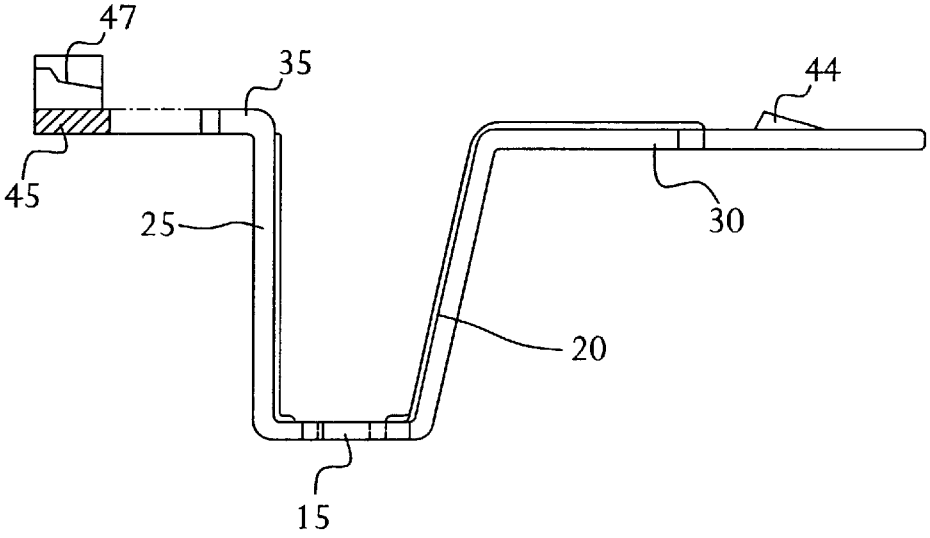
FIG. 10 shows a side view of another exemplary hold-down in accordance with the present invention.
Figure 11:
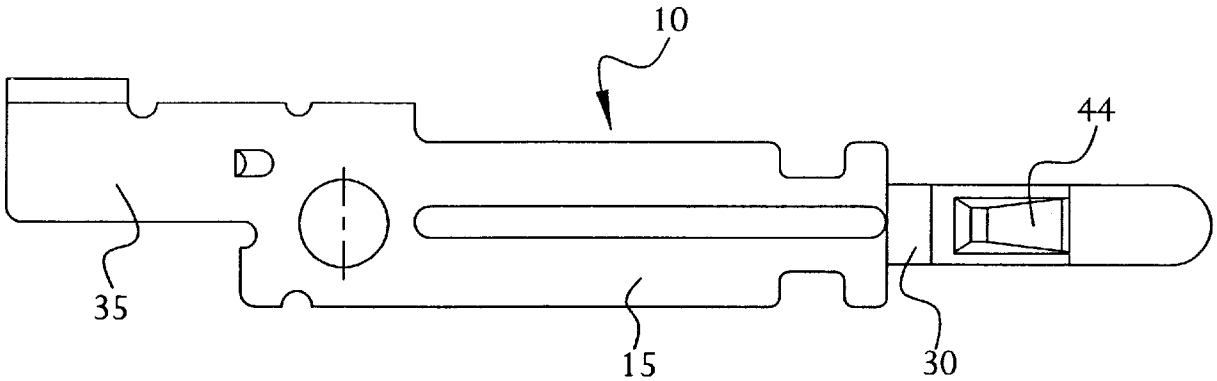
FIG. 11 shows a top view of the hold-down of FIG. 10.
Figure 12:
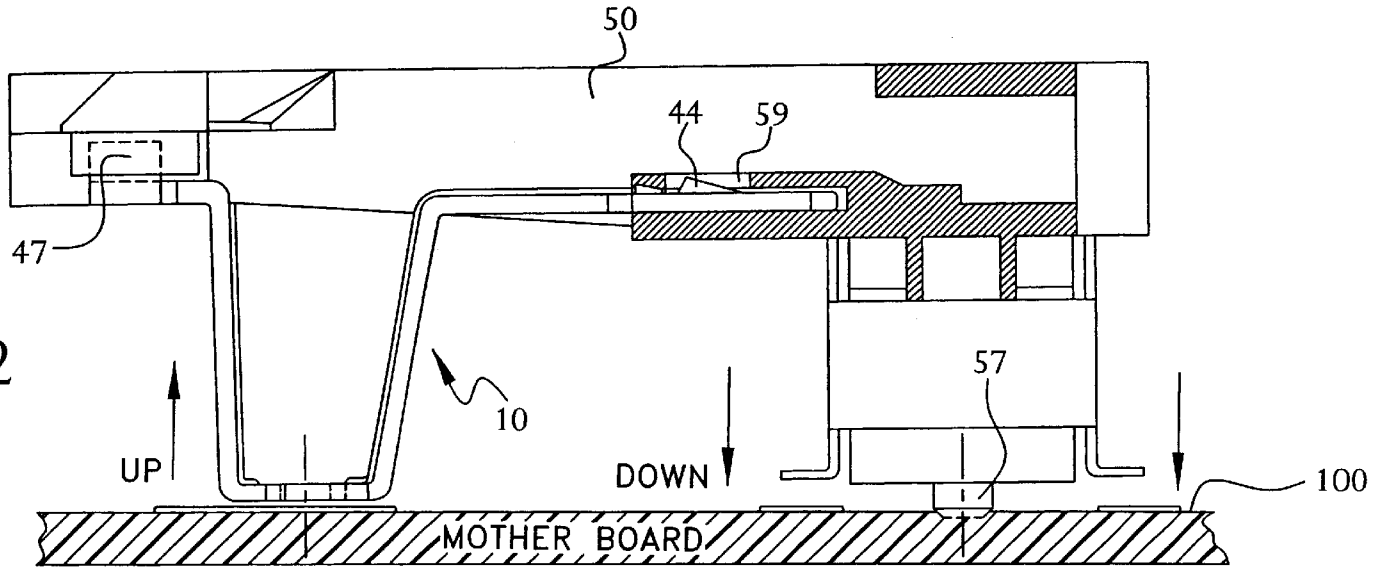
FIG. 12 shows a side view of the hold-down of FIG. 10 incorporated into a connector housing in accordance with the present invention, prior to mounting to a substrate.
Figure 13:
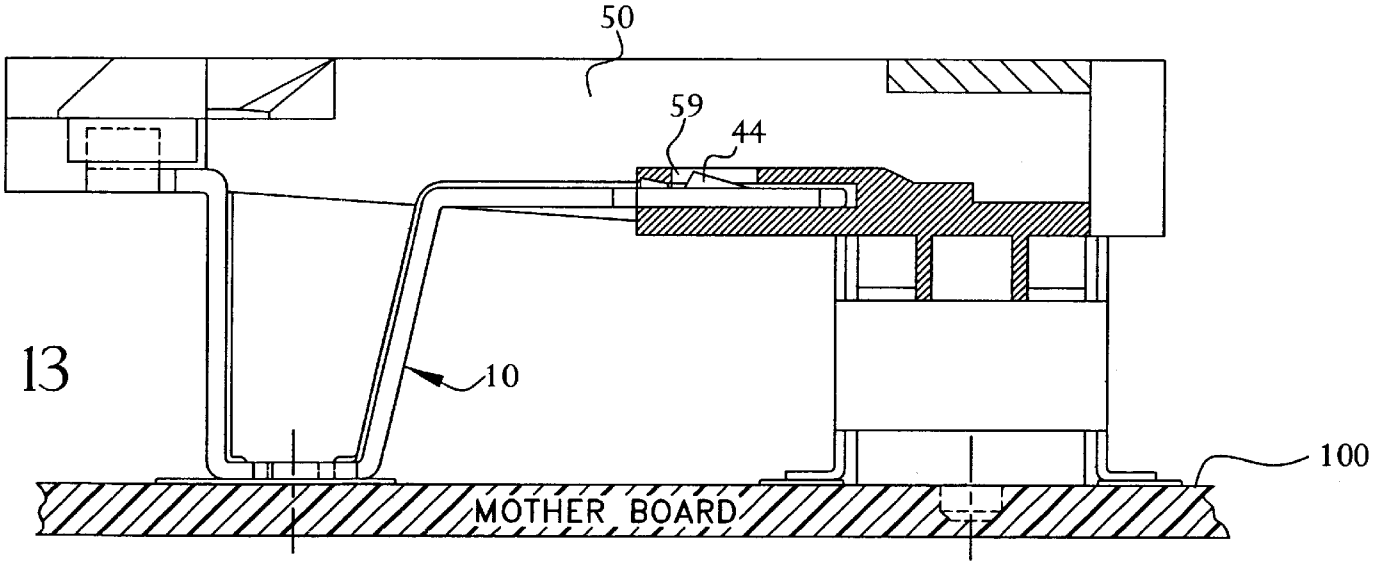
FIG. 13 shows a side view of the hold-down assembly of FIG. 12 after mounting to a substrate.

FIG. 10 shows a side view of another exemplary hold-down in accordance with the present invention, and FIG. 11 shows a top view of the hold-down of FIG. 10. The hold-down is similar to those described with respect to FIGS. 1 and 3, with the additional feature that a bump or tab 44 is disposed on a surface of the portion 30. The tab 44 on the hold-down 10 corresponds to an opening or aperture 59 in the housing 50. During mounting of the hold-down to a substrate 100, as shown in FIGS. 12 and 13, the tab 44 is inserted into the aperture 59. After insertion, tab 44 prevents hold-down 10 from exiting groove 55. In this manner, the hold-down is free floating in the vertical direction. This free floating provides a self-positioning connector when mounted to the substrate 100. During mounting, the hold-down touches the first allowable clearance in the housing slot. This allows the hold-down to rotate up as the housing is positioned on the substrate. Tab 47, as with the earlier embodiments, limits the lateral movement of hold-down 10.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A hold-down and an insulator housing, said hold-down to a printed circuit comprising:

a base;

a first portion formed at one end of the base at a first predetermined angle, a first terminal extending from the other end of the first portion and substantially parallel to the base; and a second portion formed at the other end of the base at a second predetermined angle, a second terminal extending from the other end of the second portion and substantially parallel to the base, the second terminal having limited floating movement in the insulator housing.

2. The hold-down and insulator housing according to claim 1, wherein the second terminal has a retaining feature formed towards an end thereof.

3. The hold-down and insulator housing according to claim 1, wherein the first portion has one of a pivot and a tab formed on a surface thereof.

4. The hold-down and insulator housing according to claim 1, wherein the first terminal is movably retained by the insulator housing.

5. The hold-down and insulator housing according to claim 1, wherein the first terminal has one of a pivot and a barb formed towards an end thereof.

6. The hold-down according to claim 5, wherein the second terminal has a retaining feature formed towards an end thereof.

7. A hold-down assembly comprising:

a hold-down comprising:

a base;

a first portion formed at one end of the base at a first predetermined angle, a first terminal extending from the other end of the first portion and substantially parallel to the base; and a second portion formed at the other end of the base at a second predetermined angle, a second terminal extending from the other end of the second portion and substantially parallel to the base; and an insulator housing having a first slot disposed at one end for receiving the first terminal of the hold-down and a second slot disposed at the other end for receiving the second portion of the hold-down, wherein the second terminal having limited floating movement in the insulator housing.

8. The hold-down assembly according to claim 7, wherein the insulator housing further comprises lead-ins for guiding the first terminal into the first slot.

9. The hold-down assembly according to claim 7, wherein the second terminal has a retaining feature formed towards an end thereof, and the insulator housing comprises an associated tab for interacting with the retaining feature.

10. The hold-down assembly according to claim 7, wherein the insulator housing further comprises a plug for providing additional stability and support during connection to the printed circuit board.

11. The hold-down assembly according to claim 7, wherein the first terminal has one of a pivot and a barb formed towards an end thereof, the pivot or barb contacting a sidewall of the first slot for providing lateral force during connection to the printed circuit board.

12. The hold-down assembly according to claim 7, wherein the first portion has one of a bump and a tab formed on a surface thereof, and the insulator housing has an associated aperture for receiving the tab during connection to the printed circuit board.

13. The hold-down assembly according to claim 7, wherein the first terminal is movably retained by the insulator housing.

14. An electrical connector mountable to a printed circuit board, comprising:

a hold-down comprising:

a base for engaging the circuit board;

a first portion formed at one end of the base; and a second portion formed at the other end of the base;

an insulative housing having a first slot disposed at one end receiving the first portion of the hold-down in a floatingly retained manner; and a plurality of contacts secured to the housing.

15. The connector according to claim 14, wherein the housing further comprises a second slot opposite said first slot, said second slot receiving the second portion of the hold-down in a movably retained manner.

16. The connector according to claim 14, wherein the housing further comprises lead-ins for guiding the first portion into the first slot.

17. The connector according to claim 14, wherein the second portion has a retaining feature formed towards an end thereof, and the housing comprises an associated tab for interacting with the retaining feature.

18. The connector according to claim 14, wherein the housing further comprises a plug for providing additional stability and support during connection to the printed circuit board.

19. The connector according to claim 14, wherein the first portion has one of a pivot and a barb formed towards an end thereof, the pivot or barb contacting a sidewall of the first slot for providing lateral force during connection to the printed circuit board.

20. The connector according to claim 14, wherein the first portion has one of a bump and a tab formed on a surface thereof, and the housing has an associated aperture for receiving the tab during connection to the printed circuit board.

* * * * *

UNITED STATES PATENT AND TRADEMARK OFFICE

CERTIFICATE OF CORRECTION

PATENT NO. : 6,312,286 B1
DATED : November 6, 2001
INVENTOR(S) : Joel D. Fetter et al.

It is certified that error appears in the above-identified patent and that said Letters Patent is hereby corrected as shown below:

Column 5,
Line 39, a period "." should be inserted between the words "itself" and "The."

Column 6,
Line 27, the word "tab" should be deleted and the word "barb" inserted.
Line 34, the word "barb" should be deleted and the word "tab" inserted.

Signed and Sealed this

Twenty-third Day of July, 2002

*Attest:*

*Attesting Officer*

JAMES E. ROGAN
*Director of the United States Patent and Trademark Office*